US008228238B2

(12) United States Patent
Thiam et al.

(10) Patent No.: US 8,228,238 B2
(45) Date of Patent: Jul. 24, 2012

(54) LOW PROFILE ANTENNA ASSEMBLIES

(75) Inventors: Cheikh T. Thiam, Grand Blanc, MI (US); Andreas D. Fuchs, Lake Orion, MI (US); John V. Kowalewicz, Ortonville, MI (US); Ralf Lindackers, Royal Oak, MI (US)

(73) Assignee: Laird Technologies, Inc., Earth City, MO (US)

( * ) Notice: Subject to any disclaimer, the term of this patent is extended or adjusted under 35 U.S.C. 154(b) by 454 days.

(21) Appl. No.: 12/572,716

(22) Filed: Oct. 2, 2009

(65) Prior Publication Data

US 2011/0080323 A1 Apr. 7, 2011

(51) Int. Cl.
*H01Q 1/38* (2006.01)

(52) U.S. Cl. ..... 343/700 MS

(58) Field of Classification Search ..... 343/702, 343/700 MS, 767, 895
See application file for complete search history.

(56) References Cited

U.S. PATENT DOCUMENTS

| | | | | |
|---|---|---|---|---|
| 5,706,015 | A | 1/1998 | Chen et al. | |
| 6,166,694 | A * | 12/2000 | Ying | 343/702 |
| 6,198,439 | B1 | 3/2001 | Dufrane et al. | |
| 6,353,443 | B1 * | 3/2002 | Ying | 715/702 |
| 6,448,932 | B1 | 9/2002 | Stoiljkovic et al. | |
| 6,466,170 | B2 | 10/2002 | Zhou | |
| 6,819,287 | B2 * | 11/2004 | Sullivan et al. | 343/700 MS |
| 6,882,317 | B2 | 4/2005 | Koskiniemi et al. | |
| 6,906,669 | B2 | 6/2005 | Sabet et al. | |
| 6,980,154 | B2 | 12/2005 | Vance et al. | |
| 7,023,909 | B1 * | 4/2006 | Adams et al. | 375/222 |
| 7,071,889 | B2 * | 7/2006 | McKinzie et al. | 343/756 |
| 7,081,854 | B2 * | 7/2006 | Ying et al. | 343/702 |
| 7,202,826 | B2 | 4/2007 | Grant et al. | |
| 7,388,543 | B2 | 6/2008 | Vance | |
| 7,482,991 | B2 | 1/2009 | Boyle | |
| 2003/0146872 | A1 | 8/2003 | Kellerman et al. | |
| 2004/0085244 | A1 | 5/2004 | Kadambi et al. | |
| 2007/0216597 | A1 | 9/2007 | Fujimoto et al. | |
| 2008/0231521 | A1 | 9/2008 | Anguera Pros et al. | |
| 2009/0267854 | A1 * | 10/2009 | Oksanen et al. | 343/787 |

FOREIGN PATENT DOCUMENTS

| | | |
|---|---|---|
| EP | 0999608 | 5/2000 |
| WO | WO 2004/102744 | 11/2004 |

OTHER PUBLICATIONS

European Search Report from European application No. EP 10182152.8 which is related to the instant application through a priority claim; Dec. 17, 2010; 8 pages.
Low Profile Integrated GPS and Cellular Antenna; by Nathan P. Cummings, Oct. 31, 2001, 88 pages.

(Continued)

*Primary Examiner* — Huedung Mancuso
(74) *Attorney, Agent, or Firm* — Harness, Dickey & Pierce, P.L.C.

(57) ABSTRACT

An antenna assembly including a ground plane and a radiator supported above the ground plane is disclosed. The radiator may include a slot to configure the radiator to be resonant in at least two frequency ranges and a grounding point coupled to the ground plane. The radiator may be a dual-band planar inverted F antenna (PIFA) having an upper surface opposite the ground plane. First and second antenna modules may be coupled to the upper surface of the PIFA. The first and second antenna modules may be patch antennas, such as stacked patch antennas.

26 Claims, 8 Drawing Sheets

OTHER PUBLICATIONS

Shorting Strap Tunable Single Feed Dual-Band Stacked Patch PIFA, Karmakar, N.C.; IEEE Antennas and Wireless Propagation Letters, vol. 2, Issue 2003, pp. 68-71.

Shorting Strap Tunable Stacked Patch PIFA, Karmaker, N.C.; IEEE Transactions on Antennas and Propagation, vol. 52, Issue 11, Nov. 2004, pp. 2877-2884.

* cited by examiner

LOW PROFILE ANTENNA ASSEMBLIES

FIELD

The present disclosure relates to low profile antenna assemblies.

BACKGROUND

This section provides background information related to the present disclosure which is not necessarily prior art.

Wireless devices, such as laptop computers, cellular phones, personal digital assistants (PDA), satellite based navigation and/or radio systems, etc. are commonly used in wireless operations. Multiple antennas are sometimes used for multiple applications, multiple frequencies, diversity schemes, multiple input multiple output (MIMO) applications, etc.

SUMMARY

This section provides a general summary of the disclosure, and is not a comprehensive disclosure of its full scope or all of its features.

According to various aspects, example embodiments are provided of antenna assemblies. In one example embodiment, an antenna assembly includes a ground plane and a dual-band planar inverted F antenna (PIFA) supported above the ground plane. First and second antenna modules are coupled to an upper surface of the PIFA.

According to another example embodiment, an antenna assembly includes a ground plane and a radiator supported above the ground plane. The radiator is configured to be resonant in at least two frequency ranges. The radiator includes a grounding point coupled to the ground plane. First and second patch antennas are coupled to the upper surface of the radiator. A third patch antenna element is galvanically coupled to the ground plane and galvanically separate from the radiator.

According to another example embodiment, an antenna assembly includes a ground plane and a planar inverted F antenna (PIFA) supported above the ground plane. The PIFA has an upper surface opposite the ground plane. First and second patch antennas are coupled to the upper surface of the PIFA. A third patch antenna is supported above the ground plane. A first short electrically connects the PIFA to the ground plane. A second short electrically connects the third patch antenna to the ground plane. The PIFA may be operable in at least two frequency bands without a matching circuit.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

DETAILED DESCRIPTION

Figure 1:
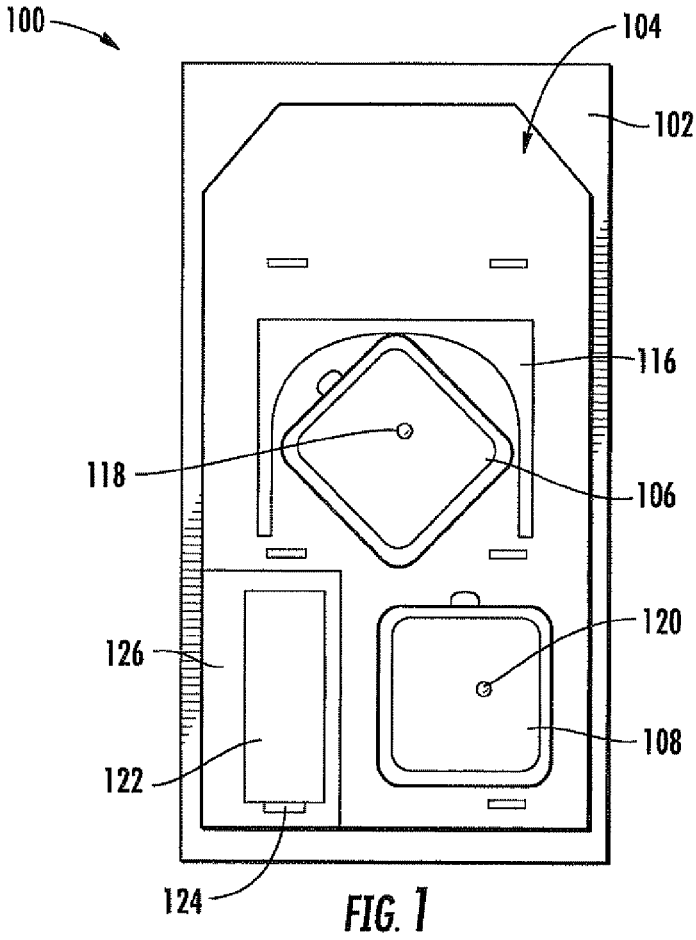
FIG. 1 is a top plan view of an example embodiment of an antenna assembly including one or more aspects of the present disclosure.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a", "an" and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on", "engaged to", "connected to" or "coupled to" another element or layer, it may be directly on, engaged, connected or coupled to the other element or layer, or intervening elements or layers may be present. In contrast, when an element is referred to as being "directly on," "directly engaged to", "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath", "below", "lower", "above", "upper" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Figure 2:
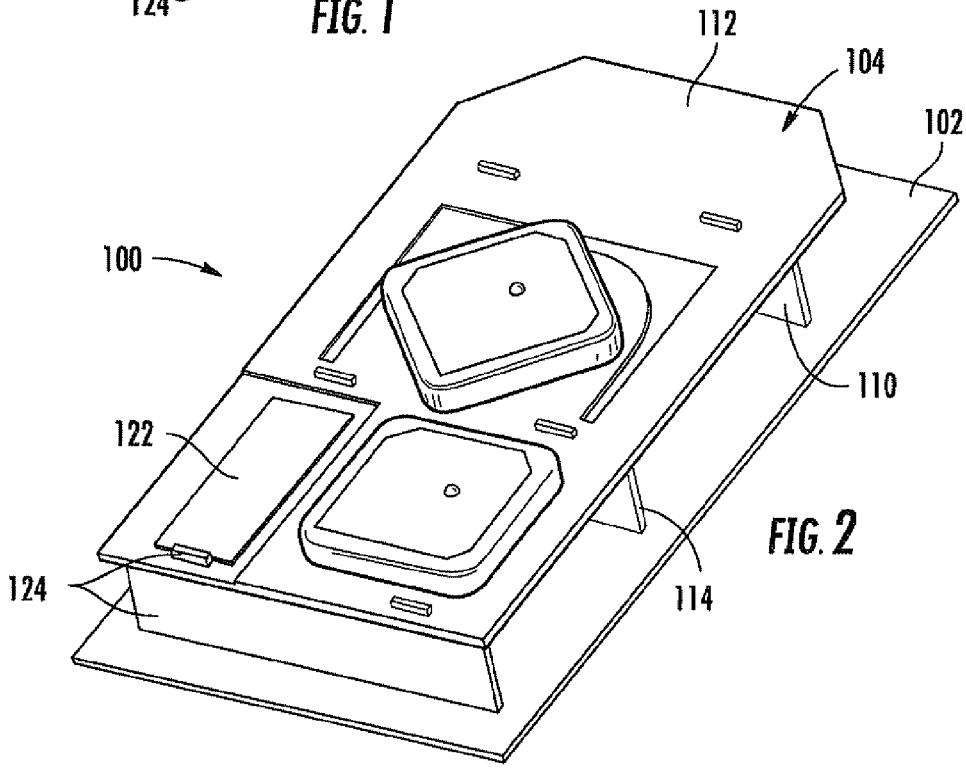
FIG. 2 is an isometric view of the antenna assembly of FIG. 1.
Figure 3:
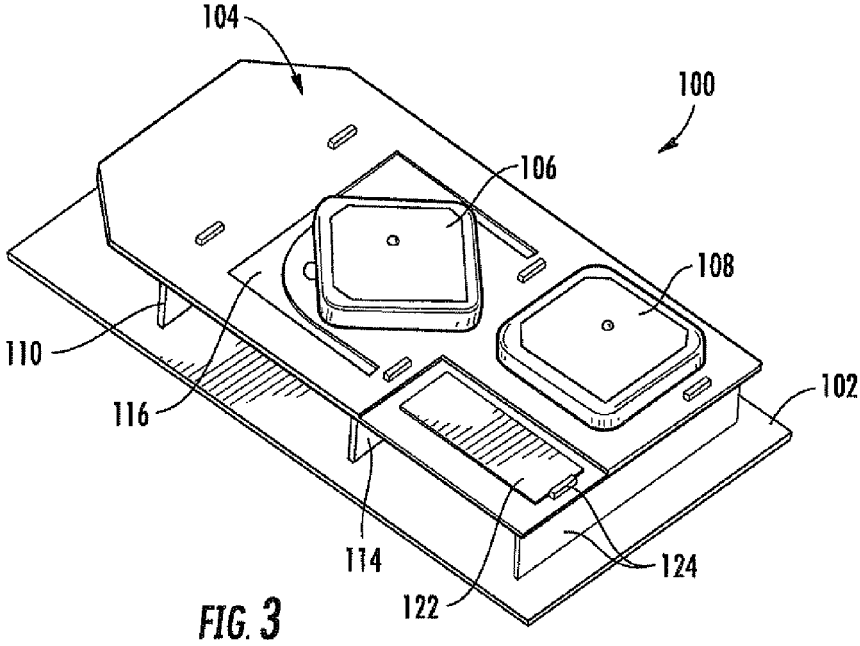
FIG. 3 is another isometric view of the assembly of FIG. 1.

With reference now to the drawings, FIGS. 1 through 3 illustrate an example embodiment of an antenna assembly 100 including one or more aspects of the present disclosure. The illustrated antenna assembly 100 includes a ground plane 102 and a planar inverted F antenna (PIFA) 104. The PIFA 104 is supported above the ground plane 102.

A first antenna module 106 is mechanically coupled to an upper surface of the PIFA 104. A second antenna module 108 is mechanically coupled to the upper surface of PIFA 104. In various embodiments, the first and second antenna modules 106, 108 are supported on top of and/or mounted on the upper surface of the PIFA 104.

Leg 110 mechanically supports a planar radiator 112 of the PIFA 104 above the ground plane 102, such that there is a spaced distance or gap (e.g., 53λ expressed millimeters in some embodiments, etc.) separating the planar radiator 112 from the ground plane 102. The leg 110 may comprise a printed circuit board (PCB) oriented generally perpendicular to the ground plane 102 and radiator 112. For example, the leg 110 may be a PCB that is operable as a feed for single band PIFA. But an alternative feeding configuration is used for the dual band mode of the PIFA 104. In addition, the leg 110 may be configured differently than a PCB and/or be oriented non-perpendicular to one or more of the ground plane 102 and radiator 112.

The PIFA 104 includes a feed point (not visible in the figures) for receiving a signal from a transceiver to be radiated by the PIFA 104 and/or to provide a signal received by the PIFA 104 to the transceiver. A first short 114 electrically connects the PIFA 104 to the ground plane 102. In the illustrated embodiment, the first short 114 may comprise a printed circuit board (PCB) oriented generally perpendicular to the ground plane 102 and the radiator 112. Alternative embodiments may include a short configured differently than a PCB (e.g., a short formed from electrically-conductive material, such as metal, etc.) and/or oriented non-perpendicular to the ground plane 102 and/or radiator 112.

The PIFA 104 may be configured for resonance in any suitable frequency or frequencies. In this example embodiment, the PIFA 104 includes a slot 116. The illustrated slot 116 is substantially shaped like the English language letter "U". But the slot 116 may have any other suitable shape, for example a line, a curve, a wavy line, a meandering line, multiple intersecting lines, and/or non-linear shapes, etc, without departing from the scope of this disclosure. The slot 116 is an absence of electrically-conductive material in the planar radiator 112. For example, the planar radiator 112 may be initially formed with the slot 116, or the slot 116 may be formed by removing electrically-conductive material from the radiator 112, such as etching, cutting, stamping, etc. In still yet other embodiments, the slot 116 may be formed by an electrically nonconductive or dielectric material, which is added to the planar radiator such as by printing, etc.

The slot 116 divides the planar radiator 112 to configure the PIFA 104 to be resonant in two frequency bands. In some embodiments, the slot 116 configures the PIFA 104 to radiate in AMPS (Advanced Mobile Phone System) and PCS (Personal Communication Service) frequency bands which are 824 to 894 megahertz and 1850 to 1990 megahertz. Accordingly, the PIFA 104, in some embodiments, may be used as a mobile telephone antenna.

The first and second antenna modules 106, 108 may be patch antennas coupled to the upper surface of the PIFA 104. In the illustrated embodiment, the first and second antenna modules 106, 108 are patch antennas that are each mounted to the upper surface of the PIFA 104. Alternatively, the first and second antenna modules 106, 108 may be stacked patch antennas—the lower patch of which is mounted directly to the upper surface of the PIFA 104, while the upper patch is stacked on top of the lower patch. The antenna modules 106, 108 may be coupled to the upper surface of the PIFA 104 using a wide range of mounting means or methods, such as electrically-conductive adhesive tape, dielectric adhesive tape, etc. In the illustrated embodiment, the antenna modules 106, 108 are mechanically and electrically connected to the upper surface of the PIFA 104, for example, by electrically-conductive adhesive tape. In alternative embodiments, however, the first and second antenna modules 106, 108 may be electrically isolated or galvanically separated from the PIFA 104, such as by electrically non-conductive or dielectric material disposed between the bottom surface of the antenna modules 106, 108 and the top surface of the PIFA 104. In these alternative embodiments, the antenna modules 106, 108 may each include a dielectric bottom surface, layer, or substrate that galvanically separates the antenna modules 106, 108 from the PIFA 104.

The first antenna module 106 transmits received signals by connection of a conductor to a feed point 118. The conductor passes through the planar radiator 112 and the ground plane 102 without galvanic connection. The conductor is then routed to a receiver for the signals it carries. Similarly, the second antenna module 108 transmits received signals by connection of a conductor to a feed point 120. This conductor also passes through the planar radiator 112 and the ground plane 102 without galvanic connection and is then routed to a receiver for the signals it carries. By way of example, the conductors associated with the first and second antenna modules 106, 108 may pass through holes or other openings in the radiator 112 and ground plane 102, or they may go around the radiator 112 and ground plane 102. The conductors may include outer insulators or layers formed from dielectric or electrically nonconductive material, which helps to galvanically separate or electrically isolate the conductors from the radiator 112 and ground plane 102.

In an example embodiment, the first antenna module 106 is a satellite navigation antenna (e.g., a Global Positioning System (GPS) antenna, etc.) and the second antenna module 108 is a satellite radio antenna (e.g., an XM radio antenna, etc.). Alternatively, the second antenna module 108 may be a satellite navigation antenna, while the first antenna module 106 may be a satellite radio antenna.

In the example assembly 100, the first antenna module 106 is mechanically coupled to the PIFA 104 with an orientation that is rotated (e.g., 45 degrees counterclockwise in FIG. 1, etc.) relative to the second antenna module 108. If the first and second antenna modules 106, 108 were identically oriented (particularly when the one module is a GPS antenna and the other module is an XM radio antenna), the E-Plane of the first and second antenna modules 106, 108 may be aligned and the antenna modules 106, 108 may be strongly coupled. By rotating the orientation of the first antenna module 106, the coupling between the antenna modules 106, 108 may be decreased.

In the example embodiment of FIGS. 1 through 3, the assembly 100 includes a patch antenna 122 substantially coplanar with the PIFA 104. A second short 124 electrically connects the patch antenna 122 to the ground plane 102. In the illustrated embodiment, the second short 124 may comprise a printed circuit board (PCB) oriented generally perpendicular to the ground plane 102, radiator 112, and patch antenna 122. Alternative embodiments may include a short configured differently than a PCB (e.g., a short formed from an electrically-conductive material, such as metal, etc.) and/or oriented non-perpendicular to one or more of the ground plane 102, radiator 112, and patch antenna 122.

A feed point (not visible in the figures) transmits signals to be radiated by the patch antenna 122 and/or signals received by the patch antenna 122 to a receiver, transmitter, and/or transceiver. An electrically nonconductive area (or slot) 126 separates the patch antenna 122 from direct mechanical (or galvanic) connection to the planar radiator 112 of the PIFA 104. In some embodiments, the patch antenna 122 is a Wi-Fi antenna. Alternative embodiments may include an antenna 122 configured as a different type of antenna besides a Wi-Fi patch antenna.

As has been discussed above, the antenna assembly 100 may include several different antennas to be useful for one or more purposes. The assembly 100 may include a multi-band cell phone antenna (the PIFA 104), a GPS antenna (antenna module 106 or 108), an XM radio antenna (antenna module 106 or 108), and a Wi-Fi antenna (patch antenna 122). Plus, the PIFA 104 may be configured to be operable in two frequency bands (e.g., AMPS and PCS, 824 to 894 megahertz and 1850 to 1990 megahertz, etc.) without any matching circuit being needed, and there is a shorting trap (e.g., first short 114, etc.) for the dual band operation. In various embodiments, the probe/feed are properly positioned relative to the PIFA to provide good impedance matching, such that no matching circuit is required. As disclosed above, the antenna assembly 100 includes the first short 114 that electrically connects the PIFA 104 to the ground plane 102, and the second short 124 that electrically connects the patch antenna 122 to the ground plane 102. Accordingly, the antenna assembly 100 of this example embodiment incorporates several antennas into a single relatively compact and relatively low-profile assembly. In an example embodiment, the antenna assembly 100 may be dimensionally sized with a length of about 65 millimeters, a width of about 56 millimeters, and a height of about 18 millimeters. Alternative embodiments may include antenna assemblies configured differently and in different sizes. The dimensions provided in this paragraph (as are all dimensions disclosed herein) are for purposes of illustration only and not for purposes of limitation.

Figure 4:
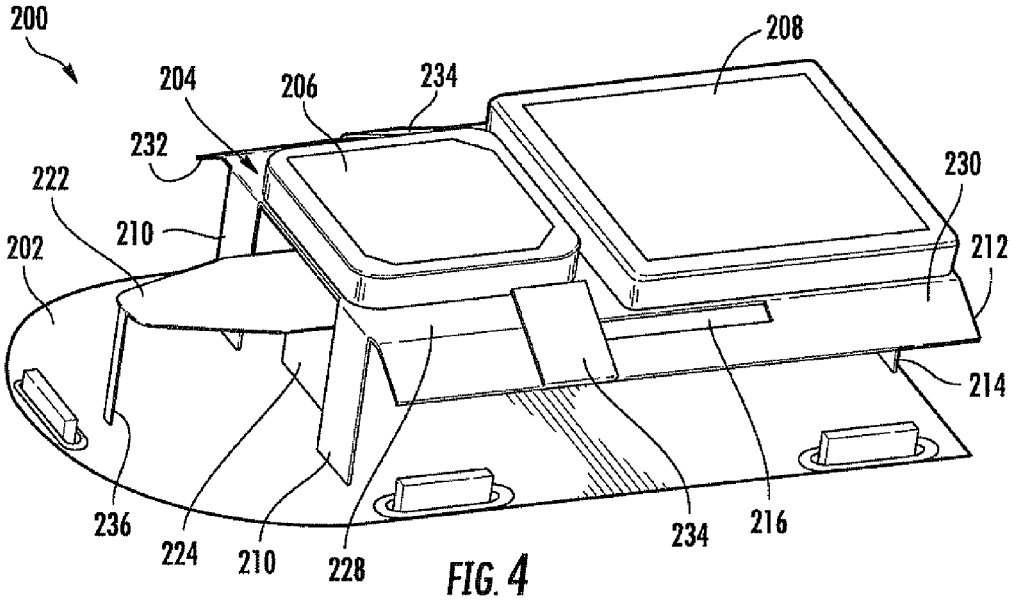
FIG. 4 is an isometric view of another example embodiment of an antenna assembly including one or more aspects of the present disclosure.

FIG. 4 illustrates another example embodiment of an antenna assembly 200 including one or more aspects of the present disclosure. The illustrated antenna assembly 200 includes a ground plane 202 and a planar inverted F antenna (PIFA) 204. The PIFA 204 is supported above the ground plane 202. A first antenna module 206 is mechanically coupled to an upper surface of the PIFA 204. A second antenna module 208 is mechanically coupled to the upper surface of PIFA 204.

In the illustrated embodiment shown in FIG. 4, two legs 210 mechanically supporting a radiator 212 above the ground plane 202 such that there is a spaced distance or gap (e.g., 53λ expressed millimeters in some embodiments, etc.) separating the radiator 212 from the ground plane 202. In some embodiments, either or both of the legs 210 may comprise a printed circuit board (PCB) oriented generally perpendicular to the ground plane 202 and radiator 212. For example, the leg(s) 210 may comprise a PCB that is operable as a feed for a single band PIFA. But an alternative feeding configuration is used for the dual band mode of the PIFA 204. In addition, the leg 210 may be configured differently than a PCB and/or be oriented non-perpendicular to one or more of the ground plane 202 and radiator 212.

The PIFA 204 includes a feed point (not visible in the figures) for receiving a signal from a transceiver to be radiated by the PIFA 204 and/or to provide a signal received by the PIFA 204 to the transceiver. A first short 214 electrically connects the PIFA 204 to the ground plane 202. In the illustrated embodiment, the first short 214 may comprise a printed circuit board (PCB) oriented generally perpendicular to the ground plane 202 and the radiator 212. Alternative embodiments may include a short configured differently than a PCB (e.g., a short formed from electrically-conductive material, such as metal, etc.) and/or oriented non-perpendicular to the ground plane 202 and/or radiator 212.

The radiator 212 includes a substantially planar portion 228 in a first plane and bent portions 230, 232. Bent portion 230 lies substantially in a second plane intersecting the first plane at a first angle (e.g., about 45 degrees in FIG. 4, etc.) relative to the first plane. Similarly, bent portion 232 lies substantially in a third plane intersecting the first plane at a second angle (e.g. about 45 degrees in FIG. 4, etc.) relative to the first plane. The first and second angles may be equal to or be different from each other. The bent portions 230, 232 decrease the width of the assembly 200 without significantly impacting performance of the assembly 200.

The PIFA 204 may be configured for resonance in any suitable frequency or frequencies. In this example embodiment, the PIFA 204 includes a slot 216. The slot 216 (which is not completely visible in FIG. 4) may be substantially shaped like the English letter "U". But the slot 216 may have any other suitable shape, for example a line, a curve, a wavy line, a meandering line, multiple intersecting lines, and/or non-linear shapes, etc, without departing from the scope of this disclosure. The slot 216 is an absence of electrically-conductive material in the planar radiator 212. For example, the planar radiator 212 may be initially formed with the slot 216, or the slot 216 may be formed by removing electrically-conductive material from the radiator 212, such as etching, cutting, stamping, etc. In still yet other embodiments, the slot 216 may be formed by an electrically nonconductive or dielectric material, which is added to the planar radiator such as by printing, etc.

The slot 216 divides the planar radiator 212 to configure the PIFA 204 to be resonant in two frequency bands. In some embodiments, the slot 216 configures the PIFA 204 to radiate in AMPS and PCS frequency bands, which are 824 to 894 megahertz and 1850 to 1990 megahertz. Accordingly, the PIFA 204, in some embodiments, may be used as a mobile telephone antenna.

The first and second antenna modules 206, 208 may be patch antennas coupled to the upper surface of the PIFA 204. In the illustrated embodiment, the first and second antenna modules 206, 208 are patch antennas that are each mounted to the upper surface of the PIFA 204. Alternatively, the first and second antenna modules 206, 208 may be stacked patch antennas—the lower patch of which is mounted directly to the upper surface of the PIFA 204, while the upper patch is stacked on top of the lower patch. The antenna modules 206, 208 may be coupled to the upper surface of the PIFA 204 using a wide range of mounting means or methods, such as electrically-conductive adhesive tape, dielectric adhesive tape, etc. In the illustrated embodiment, the antenna modules 206, 208 are mechanically and electrically connected to the upper surface of the PIFA 204, for example, by electrically-conductive adhesive tape. In alternative embodiments, however, the first and second antenna modules 206, 208 may be electrically isolated or galvanically separated from the PIFA 204, such as by electrically non-conductive or dielectric material disposed between the bottom surface of the antenna modules 206, 208 and the top surface of the PIFA 204. In these alternative embodiments, the antenna modules 206, 208 may each include a dielectric bottom surface, layer, or substrate that galvanically separates the antenna modules 206, 208 from the PIFA 204.

The first antenna module 206 transmits received signals by connection of a conductor that passes through the planar radiator 212 and the ground plane 202 without galvanic connection thereto. The conductor is then routed to a receiver for the signals it carries. Similarly, the second antenna module 208 transmits received signals by connection of a conductor that passes through the planar radiator 212 and the ground plane 202 without galvanic connection and is then routed to a receiver for the signals it carries. By way of example, the conductors associated with the first and second antenna modules 206, 208 may pass through holes or other openings in the radiator 212 and ground plane 202, or they may go around the radiator 212 and ground plane 202. The conductors may include outer insulators or layers formed from dielectric or electrically nonconductive material, which helps to galvanically separate or electrically isolate the conductors from the radiator 212 and ground plane 202.

In an example embodiment, the first antenna module 206 is a satellite navigation antenna (e.g., a GPS antenna, etc.) and the second antenna module 208 is a satellite radio antenna (e.g., an XM radio antenna, etc.). Alternatively, the second antenna module 208 may be a satellite navigation antenna, while the first antenna module 206 may be a satellite radio antenna.

The assembly 200 may include at least one lip 234. In at least one embodiment, the assembly includes two lips 234. The lip 234 is a generally planar conductor coupled to a bent portion 230, 232 of the radiator 212. The lip 234 extends in a plane parallel to the plane of the bent portion 230, 232 and extends above a portion of the slot 216. The lip 234 eliminates some of the radiation from the slot 216. If the slot 216 has a configuration, e.g., size, causing it to radiate in a frequency band close to that of one (or both) of the antenna modules 206, 208, the slot 216 radiation may depolarize the radiation from such antenna module 206, 208 and reduce the gain of the antenna module 206, 208. The lip 234 helps reduce such interference.

In the example embodiment of FIG. 4, the assembly 200 includes a patch antenna 222 substantially in a plane substantially parallel to and underneath the plane of the PIFA's planar portion 228. A second short 224 electrically couples the patch antenna 222 to the ground plane 202. In the illustrated embodiment, the second short 224 may comprise a printed circuit board (PCB) oriented generally perpendicular to the ground plane 202, radiator 212, and patch antenna 222. Alternative embodiments may include a short configured differently than a PCB (e.g., a short formed from electrically-conductive material, such as metal, etc.) and/or oriented non-perpendicular to one or more of the ground plane 202, radiator 212, and patch antenna 222.

A feed point 236 transmits signals to be radiated by the patch antenna 222 and/or signals received by the patch antenna to a receiver, transmitter, and/or transceiver. The patch antenna 222 is mechanically and galvanically separate from the PIFA 204. In some embodiments, the patch antenna 222 is a Wi-Fi antenna. Alternative embodiments may include an antenna 222 configured as a different type of antenna besides a Wi-Fi patch antenna.

As has been discussed above, the antenna assembly 200 may include several different antennas to be useful for one or more purposes. The assembly 200 may include a multi-band cell phone antenna (the PIFA 204), a GPS antenna (antenna module 206 or 208), an XM radio antenna (antenna module 206 or 208) and a Wi-Fi antenna (patch antenna 222). Accordingly, the antenna assembly 200 of this example embodiment incorporates several antennas into a single relatively compact and relatively low-profile assembly.

Figure 5:
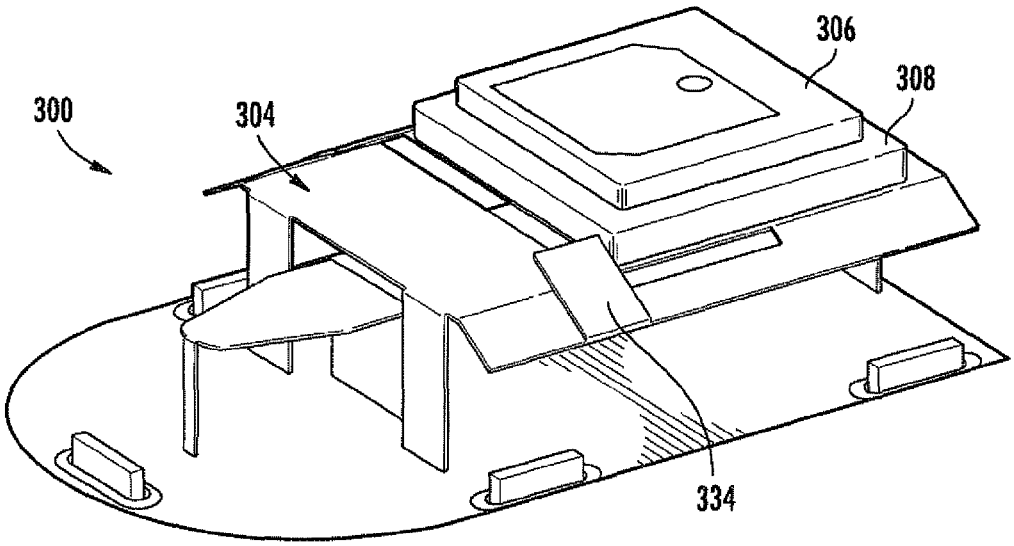
FIG. 5 is an isometric view of another example embodiment of an antenna assembly including one or more aspects of the present disclosure.

Another example embodiment of an antenna assembly 300 is shown in FIG. 5. The antenna assembly 300 is similar to the antenna assembly 200 of FIG. 4, but has a first antenna module 306 mounted or stacked on a second antenna module 308. The second antenna module 308 is mounted on an upper surface of the PIFA 304. This orientation of the antenna modules may improve performance in some instances by increasing the ground seen by the first antenna module 306.

Figure 6:
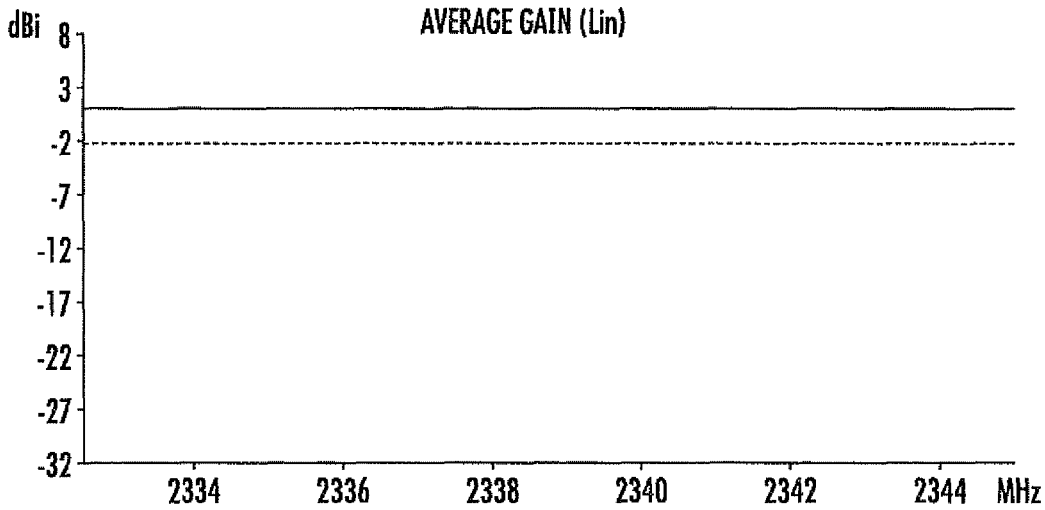
FIG. 6 is a line graph illustrating average gain in dBi (decibels relative to isotropic) for one of the antenna modules of the assembly in FIG. 5 over a frequency bandwidth of about 2332 megahertz to about 2344 megahertz, where the solid line is for left circular polarization and the dotted line is for right circular polarization.
Figure 7:
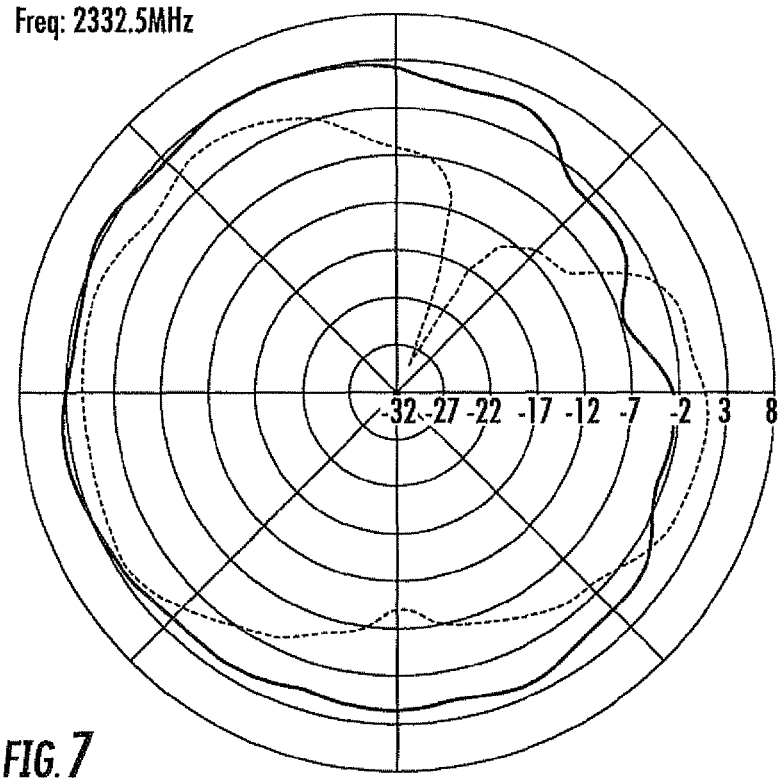
FIG. 7 is a radiation pattern plot at 2332.5 megahertz for the same antenna module of the assembly in FIG. 5 for which the line graph in FIG. 6 was created, where the solid line is for left circular polarization and the dotted line is for right circular polarization.
Figure 8:
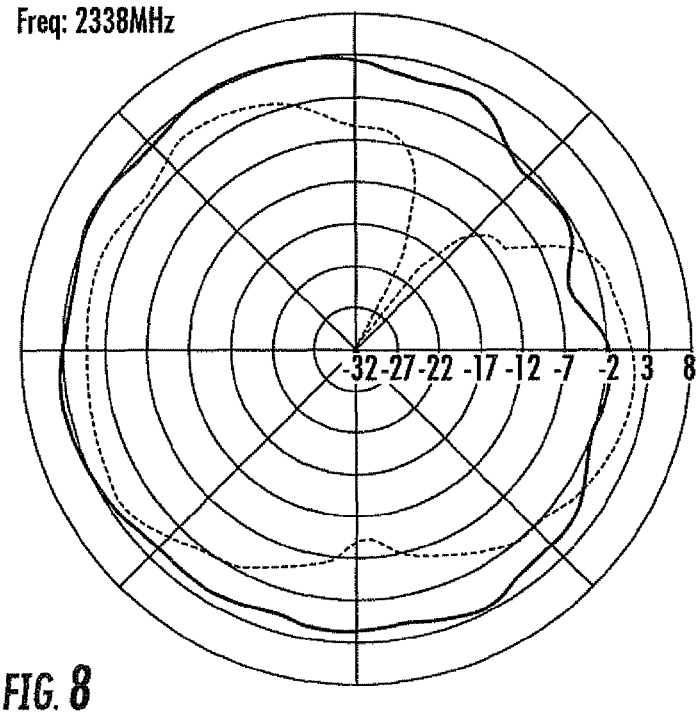
FIG. 8 is a radiation pattern plot at 2338 megahertz for the same antenna module of the assembly in FIG. 5 for which the line graph in FIG. 6 was created, where the solid line is for left circular polarization and the dotted line is for right circular polarization.
Figure 9:
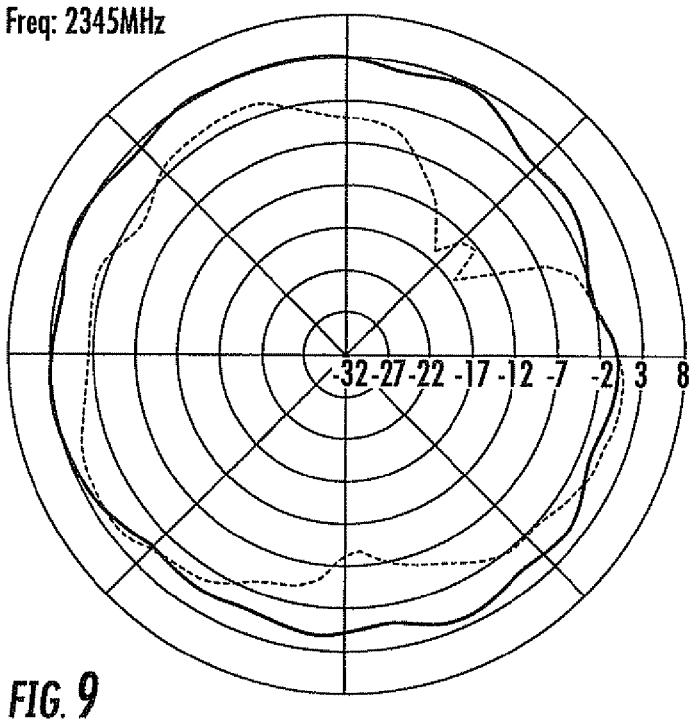
FIG. 9 is a radiation pattern plot at 2345 megahertz for the same antenna module of the assembly in FIG. 5 for which the line graph in FIG. 6 was created, where the solid line is for left circular polarization and the dotted line is for right circular polarization.

FIGS. 6 through 9 illustrate simulation results for the first antenna module 306 (where the first antenna module 306 is an XM radio antenna) of assembly 300 at forty degrees over a frequency range from about 2332 megahertz to about 2344 megahertz. FIG. 6 shows average gain in dBi (decibels relative to isotropic) for left circular polarization (solid line) and right circular polarization (dotted line). FIGS. 7, 8, and 9 plot the radiation patterns in dBi (again for left circular polarization shown in solid lines and right circular polarization shown in dotted line) of the first antenna module 306 at 2332.5 megahertz, 2338 megahertz, and 2345 megahertz, respectively.

Figure 10:
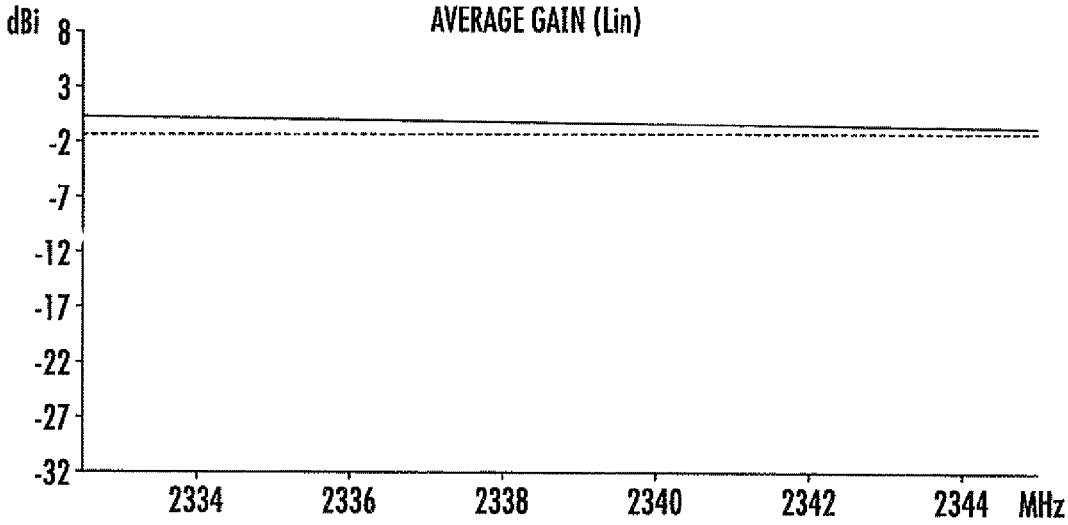
FIG. 10 is a line graph illustrating average gain in dBi over a frequency bandwidth of about 2332 megahertz to about 2345 megahertz for the same antenna module of the assembly in FIG. 5 for which the line graph in FIG. 6 was created but without a lip, and where the solid line is for left circular polarization and the dotted line is for right circular polarization.
Figure 11:
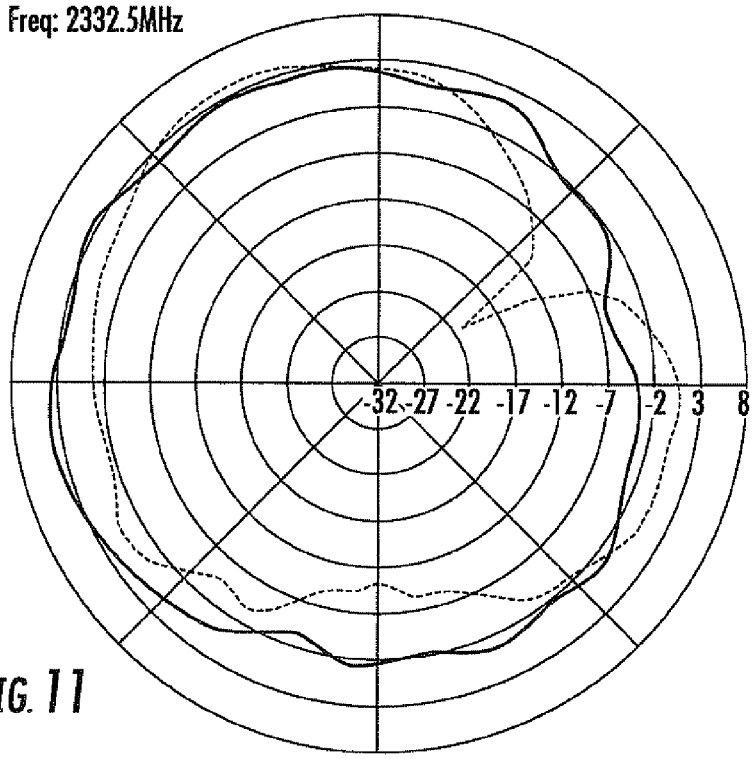
FIG. 11 is a radiation pattern plot at 2332.5 megahertz for the same antenna module of the assembly in FIG. 5 for which the line graph in FIG. 6 was created but without a lip, and where the solid line is for left circular polarization and the dotted line is for right circular polarization.
Figure 12:
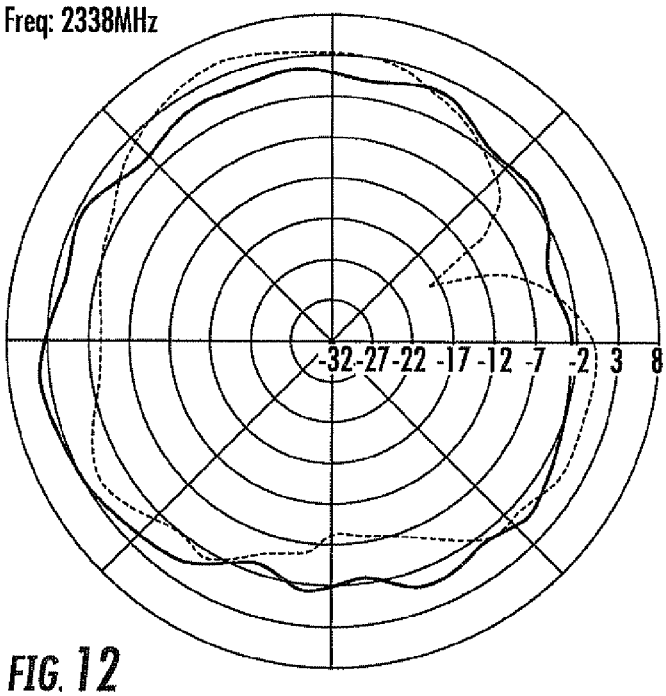
FIG. 12 is a radiation pattern plot at 2338 megahertz for the same antenna module of the assembly in FIG. 5 for which the line graph in FIG. 6 was created but without a lip, and where the solid line is for left circular polarization and the dotted line is for right circular polarization.
Figure 13:
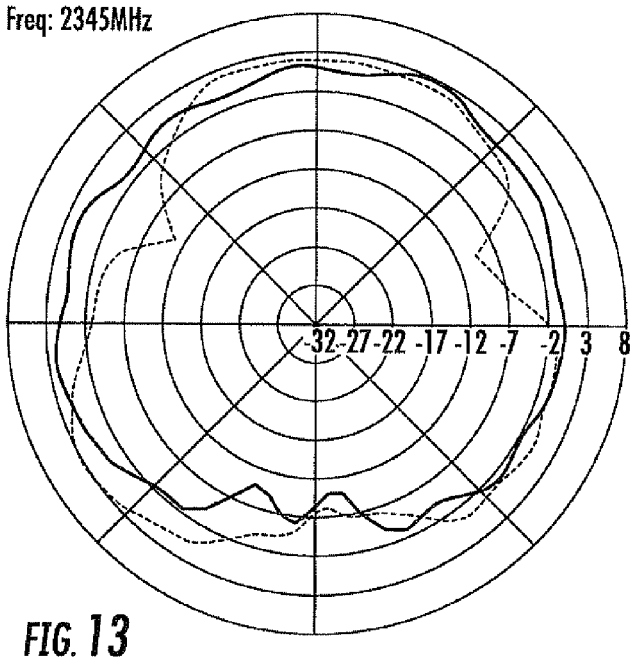
FIG. 13 is a radiation pattern plot at 2345 megahertz for the same antenna module of the assembly in FIG. 5 for which the line graph in FIG. 6 was created but without a lip, and where the solid line is for left circular polarization and the dotted line is for right circular polarization.

The affect of lips 334 on the performance of assembly 300 can be seen with comparison of FIGS. 6 through 9 with FIGS. 10 through 13. Simulation results for the first antenna module 306 (where the first antenna module 306 is an XM radio antenna) of assembly 300 with no lips 334 at forty degrees over a frequency range from about 2332 megahertz to about 2344 megahertz are illustrated in FIGS. 10 through 13. FIG. 10 shows average gain in dBi for left circular polarization (solid line) and right circular polarization (dotted line). FIGS. 11, 12, and 13 plot the radiation pattern (again for left circular polarization (solid line) and right circular polarization (dotted line)) of the first antenna module 306 at 2332.5 megahertz, 2338 megahertz, and 2345 megahertz, respectively.

Figure 15:
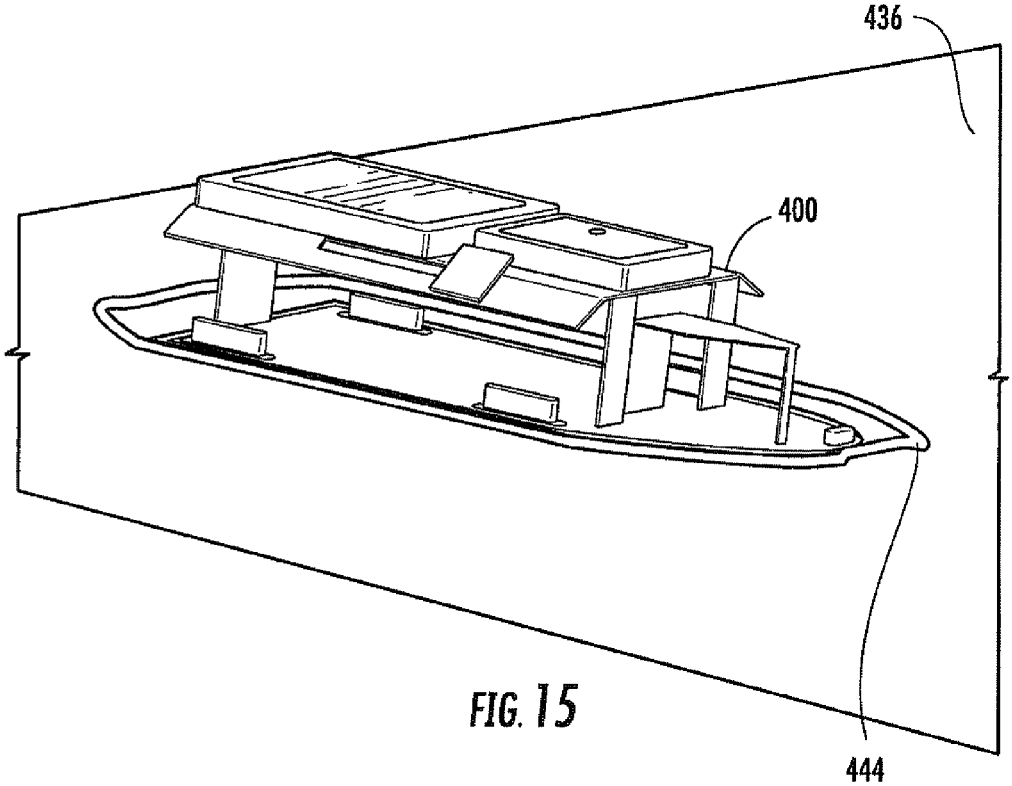
FIG. 15 is an exterior view of the assembly for a vehicle shown in FIG. 14 mounted to a vehicle surface.
Figure 16:
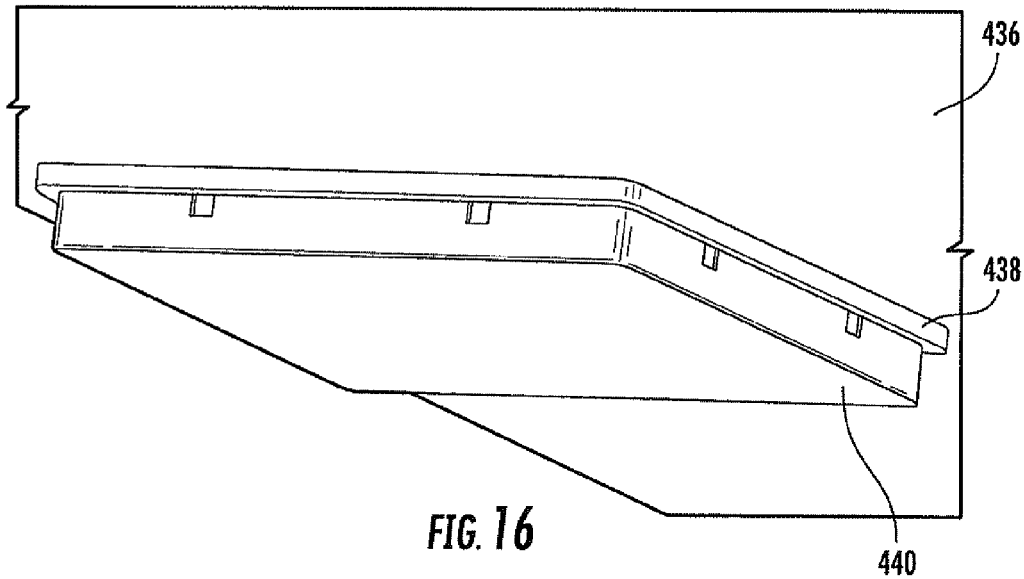
FIG. 16 is an interior view of the assembly for a vehicle shown in FIG. 14 mounted to a vehicle surface.

The antenna assemblies discussed above may be used in any appropriate application. On example use for the assemblies above is in a vehicle. Integration of multiple wireless devices into vehicles is becoming relatively common. The antenna assemblies of this disclosure integrate multiple antennas into a single assembly. An example of such an application for the antenna assemblies of this disclosure is illustrated in FIGS. 14 through 16.

Figure 14:
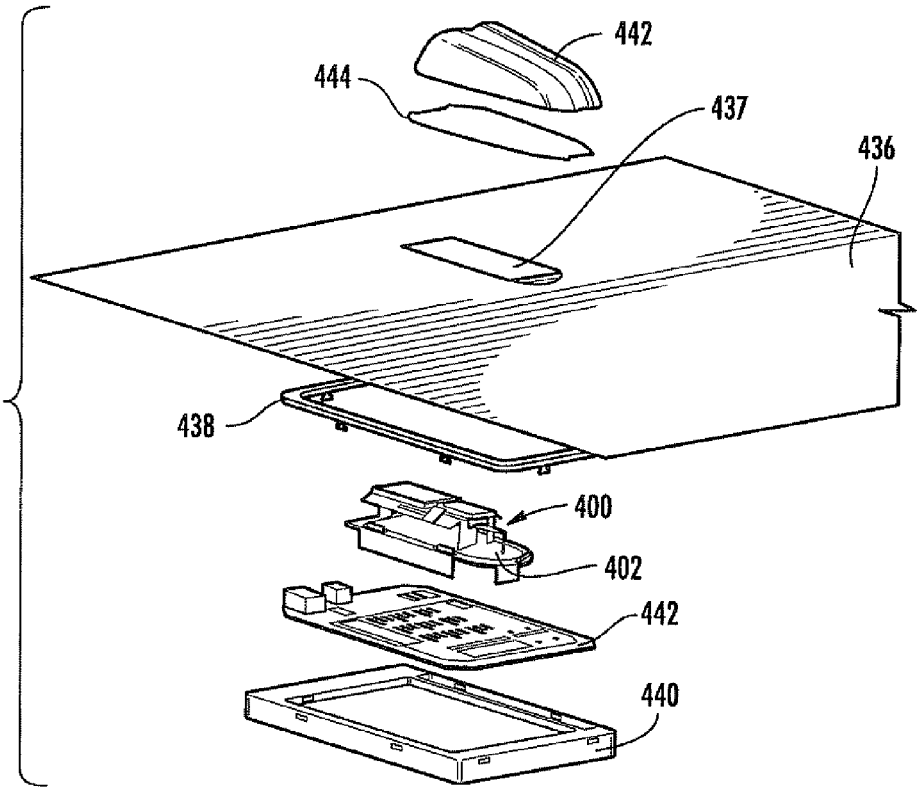
FIG. 14 is an exploded view of an assembly for a vehicle including an antenna assembly according to one or more aspects of the present disclosure.

FIG. 14 is an exploded view of a use of an antenna assembly 400 with a vehicle. A surface 436 (e.g., a roof, trunk, etc.) of the vehicle has an opening 437 through which part of the assembly 400 will pass from an interior of the vehicle to an exterior of the vehicle (as seen in FIG. 15). On the interior side of the surface, a latch (or fastener) 438 is attached to the interior surface. The latch 438 removably couples a shield can 440 to the interior surface (as seen in FIG. 16). A portion of the assembly 400 and a receiver 442 are housed within an enclosure defined by the shield can 440 and the interior surface when the shield can 440 is attached to the latch 438. The receiver 442 can be connected to one or all of the antenna element (modules, PIFA, patch antenna, etc.) in the assembly 400. In some embodiments, a plurality of the antenna elements are coupled to the receiver 442. A single signal cable from the receiver 442 is used to deliver signals received from the plurality of elements to another location for use in the vehicle (such as to a dashboard of a car) instead of using a separate signal cable for each signal. The portion of the assembly 400 above the ground plane 402 extends through the opening 437 and is protected by a radome 442 attached to the exterior side of the surface 436. A seal 444 (e.g., an elastomeric seal, etc.) between the radome 442 and the surface 436 helps seal the interface (e.g., seal the interface from ingress/egress of dust, liquid, etc.) between the radome 442 and the surface 436.

Accordingly, exemplary embodiments of an antenna assembly (e.g., 100, 200, 300, 400, etc.) are disclosed herein that may include several different antennas to be useful for one or more purposes. The antenna assembly may include a multi-band cell phone antenna (e.g., PIFA 104, 204, 304, etc.), a GPS antenna (e.g., antenna module 106, 108, 206, 208, 306, or 308, etc.), an XM radio antenna (e.g., antenna module 106, 108, 206, 208, 306, or 308, etc.), and a Wi-Fi antenna (e.g., patch antenna 122, 222, etc.). In various embodiments of an antenna assembly (e.g., 100, 200, 300, 400, etc.), a PIFA (e.g., 104, 204, 304, etc.) is configured to be operable in two frequency bands (e.g., AMPS and PCS, etc.) without any matching circuit being needed, and there is a shorting trap (e.g., first short 114, 214, etc.) for the dual band operation. For example, the antenna assembly may include a first short (e.g., 114, 214, 314, etc.) that electrically connects the PIFA to a ground plane (e.g., 102, 202, 402, etc.) and a second short (e.g., 124, 224, etc.) that electrically connects a patch antenna (e.g., 122, 222, etc.) to the ground plane. Accordingly, exemplary embodiments of antenna assemblies are disclosed herein that may incorporate several antennas into a single relatively compact and relatively low-profile assembly. In an example embodiment, an antenna assembly may be dimensionally sized with a length of about 65 millimeters, a width of about 56 millimeters, and a height of about 18 millimeters. Alternative embodiments may include antenna assemblies configured differently and in different sizes. The dimensions provided in this paragraph (as are all dimensions disclosed herein) are for purposes of illustration only and not for purposes of limitation.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

What is claimed is:

1. An antenna assembly comprising:

a ground plane;

a dual-band planar inverted F antenna (PIFA) supported above the ground plane, the PIFA having a planar radiator with an upper surface facing opposite the ground plane, a lower surface spaced apart from and facing the ground plane, and a slot therein that divides the planar radiator into a first portion and a second portion to configure the PIFA to be resonant in at least two frequency ranges;

a first antenna module coupled to the upper surface of the PIFA, and having a feed point conductor passing through or around the planar radiator for routing to a transceiver or receiver; and a second antenna module coupled to the upper surface of the PIFA, and having a feed point conductor passing through or around the planar radiator for routing to a transceiver or receiver.

2. The antenna assembly of claim 1 wherein the first antenna module and the second antenna module are each mounted on the upper surface of the PIFA.

3. The antenna assembly of claim 1 wherein:

the second antenna module is mounted on the upper surface of the PIFA; and the first antenna module is mounted on the second antenna module.

4. The antenna assembly of claim 1 wherein the antenna assembly is configured such that the PIFA is operable in at least two frequency bands without a matching circuit.

5. The antenna assembly of claim 1 further comprising a patch antenna supported above the ground plane.

6. The antenna assembly of claim 5 further comprising:

a first short electrically connecting the PIFA to the ground plane; and a second short electrically connecting the patch antenna to the ground plane.

7. The antenna assembly of claim 6 wherein:

the first and second antenna modules comprise respective first and second patch antennas;

the first patch antenna is mounted on the second patch antenna; and the second patch antenna is mounted on the upper surface of the PIFA.

8. The antenna assembly of claim 6 wherein:

the patch antenna is a Wi-Fi antenna;

the first antenna module is a satellite navigation system antenna;

the second antenna module is a satellite radio antenna; and the PIFA is configured to be resonant in at least two mobile telephone frequency ranges.

9. The antenna assembly of claim 5 wherein the patch antenna is substantially coplanar with the PIFA or disposed between the ground plane and a lower surface of the PIFA.

10. The antenna assembly claim 1 wherein:

the feed point conductor of the first antenna module passes through the planar radiator and ground plane without galvanic connection; and the feed point conductor of the second antenna module passes through the planar radiator and ground plane without galvanic connection.

11. The antenna assembly of claim 1 wherein the PIFA includes:

a planar portion in a first plane;

a first bent portion in a second plane intersecting the first plane at a first angle relative to the first plane; and a second bent portion in a third plane intersecting the first plane at a second angle relative to the first plane.

12. The antenna assembly of claim 1 further comprising at least one lip extending above a portion of the slot, whereby the lip is operable for reducing radiation from the slot.

13. The antenna assembly of claim 1 wherein the first antenna module is in an orientation that is rotated relative to the second antenna module to reduce coupling between the first and second antenna modules.

14. The antenna assembly of claim 1 wherein the PIFA is configured to radiate in at least two frequency bands, including a first frequency band of about 824 to 894 megahertz and a second frequency band of about 1850 to 1990 megahertz.

15. The antenna assembly of claim 1 wherein at least one of the first and second antenna modules is mechanically and electrically connected to the upper surface of the PIFA.

16. The antenna assembly of claim 1 wherein at least one of the first and second antenna modules is coupled to the upper surface of the PIFA by electrically-conductive adhesive tape.

17. An antenna assembly comprising:

a ground plane;

a radiator supported above the ground plane, the radiator having an upper surface facing opposite the ground plane, a lower surface spaced apart from and facing the ground plane, a slot therein that divides the radiator into a first portion and a second portion such that the radiator is configured to be resonant in at least two frequency ranges, and a grounding point coupled to the ground plane;

a first patch antenna coupled to the upper surface of the radiator, and having a feed point conductor passing through or around the radiator for routing to a transceiver or receiver;

a second patch antenna coupled to the upper surface of the radiator, and having a feed point conductor passing through or around the radiator for routing to a transceiver or receiver; and a third patch antenna element galvanically coupled to the ground plane and galvanically separate from the radiator.

18. The antenna assembly of claim 17 wherein the radiator is substantially planar.

19. The antenna assembly of claim 17 wherein the radiator includes:

a planar portion;

a first bent portion along a first side of the planar portion; and a second bent portion along a second side of the planar portion opposite the first side.

20. The antenna assembly of claim 17 wherein at least one lip extends above a portion of the slot, whereby the lip is operable for reducing radiation from the slot.

21. The antenna assembly of claim 17 wherein:

the second patch antenna is mounted on the upper surface of the radiator;

the first patch antenna is mounted on an upper surface of the second patch antenna;

the radiator is operable in at least two frequency bands without a matching circuit;

a first short electrically connects the radiator to the ground plane; and a second short electrically connects the third patch antenna to the ground plane.

22. The antenna assembly of claim 17 wherein the antenna assembly comprises a planar inverted F antenna (PIFA) that includes the radiator, and wherein the third patch antenna is substantially coplanar with the PIFA or disposed between the ground plane and a lower surface of the PIFA.

23. The antenna assembly of claim 17 wherein at least one of the first and second patches is mechanically and electrically connected to the upper surface of the radiator by electrically-conductive adhesive tape.

24. An antenna assembly comprising:

a ground plane;

a planar inverted F antenna (PIFA) supported above the ground plane, the PIFA having a planar radiator with an upper surface facing opposite the ground plane lower surface spaced apart from and facing the ground plane, and a slot therein that divides the planar radiator into a first portion and a second portion to configure the PIFA to be resonant in at least two frequency ranges;

a first patch antenna coupled to the upper surface of the PIFA, and having a feed point conductor passing through or around the planar radiator for routing to a transceiver or receiver;

a second patch antenna coupled to the upper surface of the PIFA, and having a feed point conductor passing through or around the planar radiator for routing to a transceiver or receiver;

a third patch antenna supported above the ground plane;

a first short electrically connecting the PIFA to the ground plane; and a second short electrically connecting the third patch antenna to the ground plane;

whereby the PIFA is operable in at least two frequency bands without a matching circuit.

25. The antenna assembly of claim 24 wherein:

the second patch antenna is mounted on the upper surface of the PIFA;

the first patch antenna is mounted on an upper surface of the second patch antenna; and the third patch antenna is substantially coplanar with the PIFA or disposed between the ground plane and a lower surface of the PIFA.

26. The antenna assembly of claim 24 wherein the PIFA includes:

a planar portion;

a first bent portion along a first side of the planar portion;

a second bent portion along a second side of the planar portion opposite the first side; and first and second lips extending above portions of the slot, whereby the first and second lips are operable for reducing radiation from the slot.

* * * * *